US006121876A

United States Patent [19]

McKenney

[11] Patent Number: 6,121,876

[45] Date of Patent: Sep. 19, 2000

[54] SYSTEM FOR ABSORBING AND OR SCATTERING SUPERFLUOUS RADIATION IN AN OPTICAL MOTION SENSOR

[75] Inventor: David I. McKenney, Orangevale, Calif.

[73] Assignee: C & K Systems, Inc., Folsom, Calif.

[21] Appl. No.: 09/047,425

[22] Filed: Mar. 24, 1998

[51] Int. Cl.[7] ..... G08B 13/18

[52] U.S. Cl. ..... 340/567; 340/541; 340/693.5; 250/353

[58] Field of Search ..... 340/567, 565, 340/693.5, 693.1, 547; 250/353, 342, DIG. 1

[56] References Cited

U.S. PATENT DOCUMENTS

| | | | |
|---|---|---|---|
| 4,268,347 | 5/1981 | Stephens | 156/628 |
| 4,271,358 | 6/1981 | Schwarz | 250/338 |
| 4,442,359 | 4/1984 | Lederer | 340/567 |
| 4,939,359 | 7/1990 | Freeman | 340/567 |
| 5,103,346 | 4/1992 | Chang | 340/567 |
| 5,128,549 | 7/1992 | Kaye | 250/372 |
| 5,414,255 | 5/1995 | Hampson | 340/567 |
| 5,424,718 | 6/1995 | Müller et al. | 340/567 |
| 5,499,016 | 3/1996 | Pantus | 340/555 |
| 5,790,040 | 8/1998 | Kreier et al. | 340/693 |

*Primary Examiner*—Jeffery A. Hofsass
*Assistant Examiner*—Anh La
*Attorney, Agent, or Firm*—John P. O'Banion

[57] ABSTRACT

An infrared intrusion sensing system comprises a compound lens having a plurality of lines of focus for focusing infrared radiation that enters the system onto a detector, and a window to allow infrared radiation to enter the system and then be focused onto the detector by a set of curvilinear-shaped mirrors. The detector is located near the focal point of the compound lens elements and curvilinear-shaped mirror elements. An enclosure surrounding the detector provides isolation from insect entry and constitutes an insect exclusion enclosure envelope. The enclosure envelope is a protective volume of space for the optical paths between the lens or window and the detector that prevents the entry of objects about 1 mm in diameter or larger which could interfere with the optical paths. Pigmenting, texturing, and/or contouring the insect exclusion enclosure surrounding the detector is provided for the purpose of absorbing and/or scattering superfluous radiation that is not focused on the detector, thereby minimizing false alarms and providing improved operating performance by the infrared intrusion sensing system. An alternate embodiment provides an insert for the insect exclusion enclosure which comprises the pigmenting, texturing and/or contouring, and permits easy update of an existing sensor systems.

37 Claims, 10 Drawing Sheets

SYSTEM FOR ABSORBING AND OR SCATTERING SUPERFLUOUS RADIATION IN AN OPTICAL MOTION SENSOR

BACKGROUND OF THE INVENTION

1. Field of the Invention

This invention relates generally to an infrared intrusion sensing system and in particular to a method and apparatus for restricting superfluous radiation not focused on a detector.

2. Description of Related Art

An infrared intrusion sensing system comprises a lens having a plurality of lines of focus for focusing infrared radiation that enters the system onto a detector. An enclosure surrounding the detector provides isolation from insect entry. The enclosure envelope is a protective volume of space for the optical path between the lens and the detector. Radiation focused by the lens in locations other than the detector is "superfluous" and is considered a source of false intrusion sensing by internal re-reflection inside the insect exclusion envelope. Elimination of superfluous radiation reaching the detector results in improved performance of the infrared intrusion sensing system and minimizes false alarms.

U.S. Pat. No. 4,268,347 issued May 19, 1981 to Richard B. Stephens describes a process for forming reflectivity surfaces by particle track etching of a dielectric material. A textured surface is produced having conical cavities. The textured surface reduces light reflections, but it does not describe or suggest application in the infrared regions.

U.S. Pat. No. 4,271,358 issued Jun. 2, 1981 to Frank Schwarz describes the use of polyhydrocarbon plastics such as polyethylene, for the housing of infrared sensors and adding dyes or coloring water which strongly absorb in the visible but which are not strong absorbers in the farther infrared.

U.S. Pat. No. 5,424,718 issued Jan. 13, 1995 to Kurt Muhler et al. describes an IR intrusion detector using scattering to prevent false alarms by radiation outside the useful radiation band. Focusing mirrors are provided with a rough surface for infrared selectivity. In the wavelength range from 6 to 15 micrometers, the infrared radiation is specularly reflected and focused in accordance with the shape of the mirrors. Extraneous radiation in the visible and near-infrared range from about 0.4 micrometer or less up to 3 micrometers is diffusely scattered. However, there is no scattering of extraneous infrared radiation to prevent such radiation from being detected.

SUMMARY OF THE INVENTION

Accordingly, it is therefore an object of this invention to absorb or scatter superfluous radiation entering an infrared intrusion sensing system.

It is another object of this invention to improve the performance of an infrared intrusion sensing system by providing means to absorb superfluous radiation and thereby reduce false alarms.

It is an object of this invention to provide a pigmentation within the walls of an insect exclusion enclosure of the infrared intrusion sensing system to absorb superfluous radiation.

It is another object of this invention to provide a textured surface on the inner walls of an insect exclusion enclosure within the infrared intrusion sensing system to scatter superfluous radiation.

It is another object of this invention to provide a contoured surface on the inner walls of an insect exclusion enclosure within the infrared intrusion sensing system to cause multiple lossy reflections of superfluous radiation within the valleys of the contours thereby attenuating the superfluous radiation.

It is another object of this invention to improve the performance of existing infared intrusion systems by simply inserting a device into the system having the shape of an insect exclusion enclosure and including pigmentation, texturing and/or contouring on the device walls to absorb or scatter superfluous radiation.

It is a further object of this invention to provide an infrared intrusion sensor having a sealed housing for insect exclusion and an internal baffle for absorbing or scattering superfluous radiation.

These and other objects are further accomplished by an intrusion sensing system comprising a front assembly having a compound lens for focusing radiation, a circuit board including a radiation detector for sensing the radiation and circuitry for processing the detected radiation, a rear assembly for mating with the front assembly and enclosing the circuit board within the front assembly and the rear assembly, and the front assembly comprises means attached to the compound lens for excluding insects from the radiation detector and preventing superfluous radiation from reaching the radiation detector. The insect excluding means comprises an opening on a first end adjacent to the compound lens for receiving the focused radiation and an opening on a second end which is smaller than the opening on the first end for accepting the radiation detector extending therethrough from the adjacent circuit board. the insect excluding means comprises a pigmentation for absorbing the superfluous radiation, a textured surface for scattering superfluous radiation, and/or a contoured surface for preventing the superfluous radiation from reflecting onto the radiation detector. The front assembly comprises another window on a bottom end of the front assembly for receiving radiation, and the radiation entering the sensing system through the bottom end window strikes mirrors above the detector for reflecting the radiation onto the radiation detector. The pigmentation provides a black color to the insect excluding means. The textured surface comprises repetitive, random deviations from a normal smooth surface to form a three-dimensional topography on the surface. The contoured surface comprises peaks and valleys for causing lossy reflections of the superfluous radiation within the valleys.

The objects are further accomplished by an intrusion sensing system comprising a front assembly having a compound lens for focusing radiation, a circuit board including a radiation detector positioned opposite the compound lens for sensing the radiation and circuitry for processing the detected radiation, a rear assembly for mating with the front assembly and enclosing the circuit board within the front assembly and the rear assembly, the front assembly comprises means attached to the compound lens for excluding insects from the radiation detector, and the front assembly further comprises means inserted within the insect excluding means for suppressing superfluous radiation. The insect excluding means and the suppressing means comprises an opening on a first end adjacent to the compound lens for receiving the focused radiation and an opening on a second end which is smaller than the opening on the first end for accepting the radiation detector extending therethrough from the adjacent circuit board. The suppressing means comprises a pigmentation for absorbing the superfluous radiation. Also, the insert suppressing means may comprise a textured surface for scattering superfluous radiation or a contoured surface for preventing the superfluous radiation from reflecting onto the radiation detector. The front assembly comprises another window on a bottom end of the front assembly for receiving radiation, and the radiation entering the sensing system through the bottom end window strikes mirrors above the detector for reflecting the radiation onto the radiation detector.

The objects are further accomplished by an intrusion sensing system comprising a front assembly having a compound lens for focusing radiation, a circuit board including a radiation detector for sensing the radiation and circuitry for processing the detected radiation, a baffle having a first open end attached around the perimeter of the radiation detector and a second open end facing the compound lens for suppressing superfluous radiation, and a rear assembly for sealably mating with the front assembly and enclosing the circuit board within the front assembly and the rear assembly thereby excluding insects from entering the sensing system. The baffle comprises an opening on a second end in front of the compound lens for receiving the focused radiation and an opening on a first end which is smaller than the opening on the second end for accepting the radiation detector extending therethrough from the adjacent circuit board. The baffle comprises a pigmentation for absorbing the superfluous radiation. Also, the baffle may comprise a textured surface for scattering superfluous radiation, or a contoured surface for preventing the superfluous radiation from reflecting onto the radiation detector. The front assembly comprises another window on a bottom end of the front assembly for receiving radiation, and the radiation entering the sensing system through the bottom end window strikes mirrors above the detector for reflecting the radiation onto the radiation detector.

The objects are further accomplished by a method of suppressing superfluous radiation in an intrusion sensing system comprising the steps of providing a front assembly having a compound lens for focusing radiation, sensing the radiation with a detector positioned on a circuit board including circuitry coupled to the detector for processing the sensed radiation, enclosing the intrusion sensing system with a rear assembly which is disposed adjacent to one side of the circuit board and joined together at the periphery of the front assembly, and providing a suppressing means within the front assembly for preventing superfluous radiation from reaching the detector and suppressing means attached to the compound lens prevents insects from entering the space envelope of the suppressing means within the system. The method comprises the step of adding a pigmentation to the material of the suppressing means for absorbing the superfluous radiation. The method also comprises the step of providing a textured surface on the suppressing means for scattering superfluous radiation. The method also comprises the step of providing a contoured surface on the suppressing means for preventing superfluous radiation from reflecting onto the radiation detector. The step of providing a contoured surface on the suppressing means comprises the step of providing peaks and valleys for causing lossy reflections of the superfluous radiation within the valleys.

The objects are further accomplished by a method of suppressing radiation in an intrusion sensing system comprising the steps of providing a front assembly having a compound lens for focusing radiation, sensing the radiation with a detector positioned on a circuit board including circuitry coupled to the detector for processing the sensed radiation, enclosing the intrusion sensing system with a rear assembly which is disposed adjacent to one side of the circuit board and joined together at the periphery of the front assembly, excluding insects from the radiation detector with enclosure means attached to the compound lens and positioned within the front assembly, and inserting within the enclosure means for suppressing superfluous radiation. The suppressing means includes the use of a pigmentation on the walls of the enclosure means, a textured surface or/and a contoured surface on such walls.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
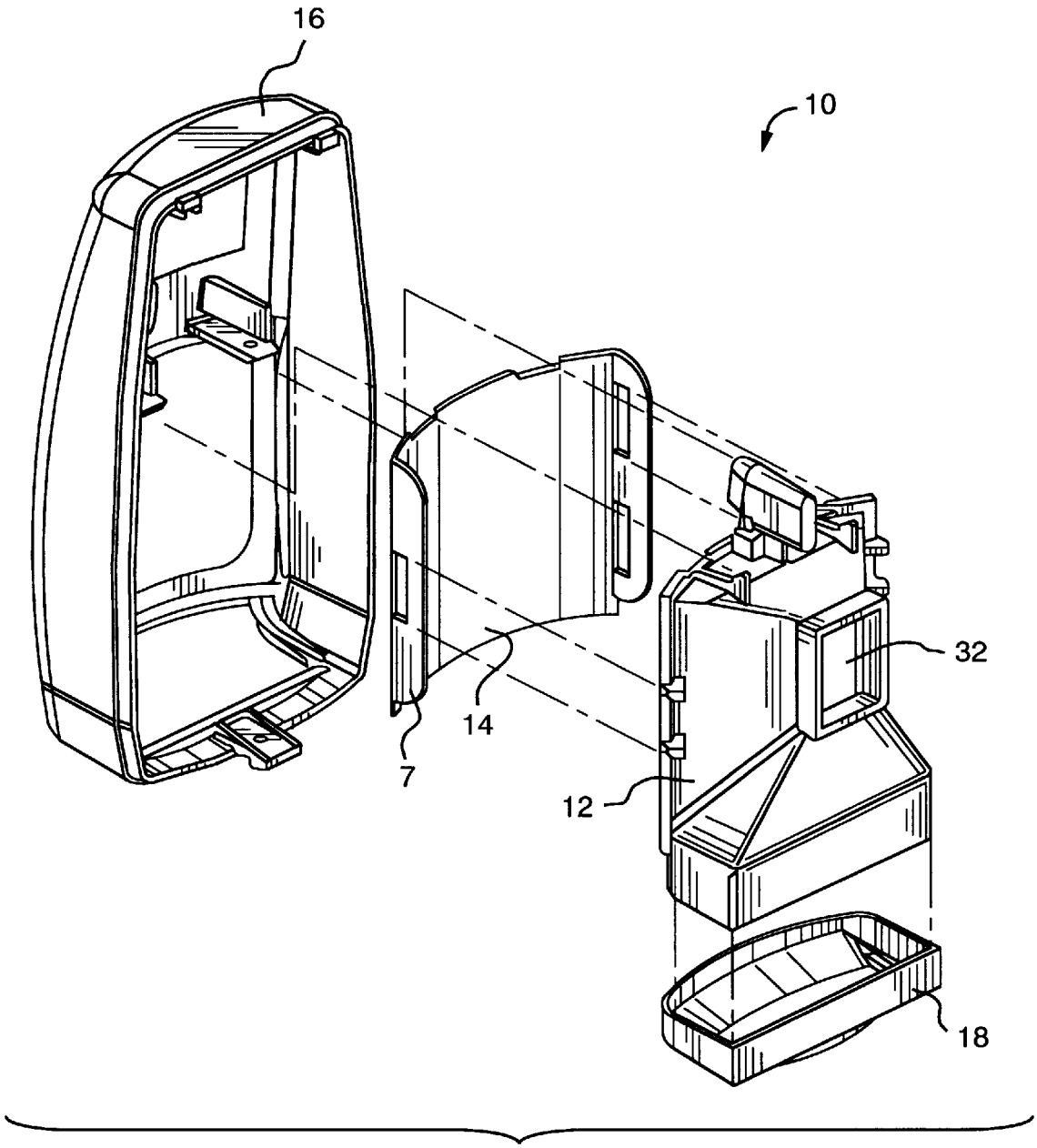
FIG. 1 is an exploded perspective view of a front assembly of an intrusion sensing system showing an insect exclusion enclosure and a compound lens.

Referring now to FIG. 1, an exploded perspective view of a front assembly 10 of an intrusion sensing system 11 is shown which incorporates the invention of an insect exclusion enclosure 12 comprising means for absorbing or scattering superfluous radiation that is not focused on a detector 26. The insect exclusion enclosure 12 further provides a protected volume of space for optical paths between lenses 14, window 18 and a radiation detector 26 by preventing the entry of objects approximately 1 mm in diameter or larger which could interfere with the optical paths. Reducing superfluous radiation results in improved operating performance by minimizing false alarms for such an intrusion sensing system. A compound lens 14 attaches to the front of the insect exclusion enclosure 12 and has a plurality of lines of focus for focusing infrared radiation that enters the system onto the detector 26. The detector 26 is located near the focal point of the compound lens 14 and the curvilinear-shaped mirror 24. A window enclosure 18 provides for another source of radiation to reach the detector in addition to the compound lens 14. A front housing 16 encloses the compound lens 14 and the insect exclusion enclosure 12.

Figure 2:
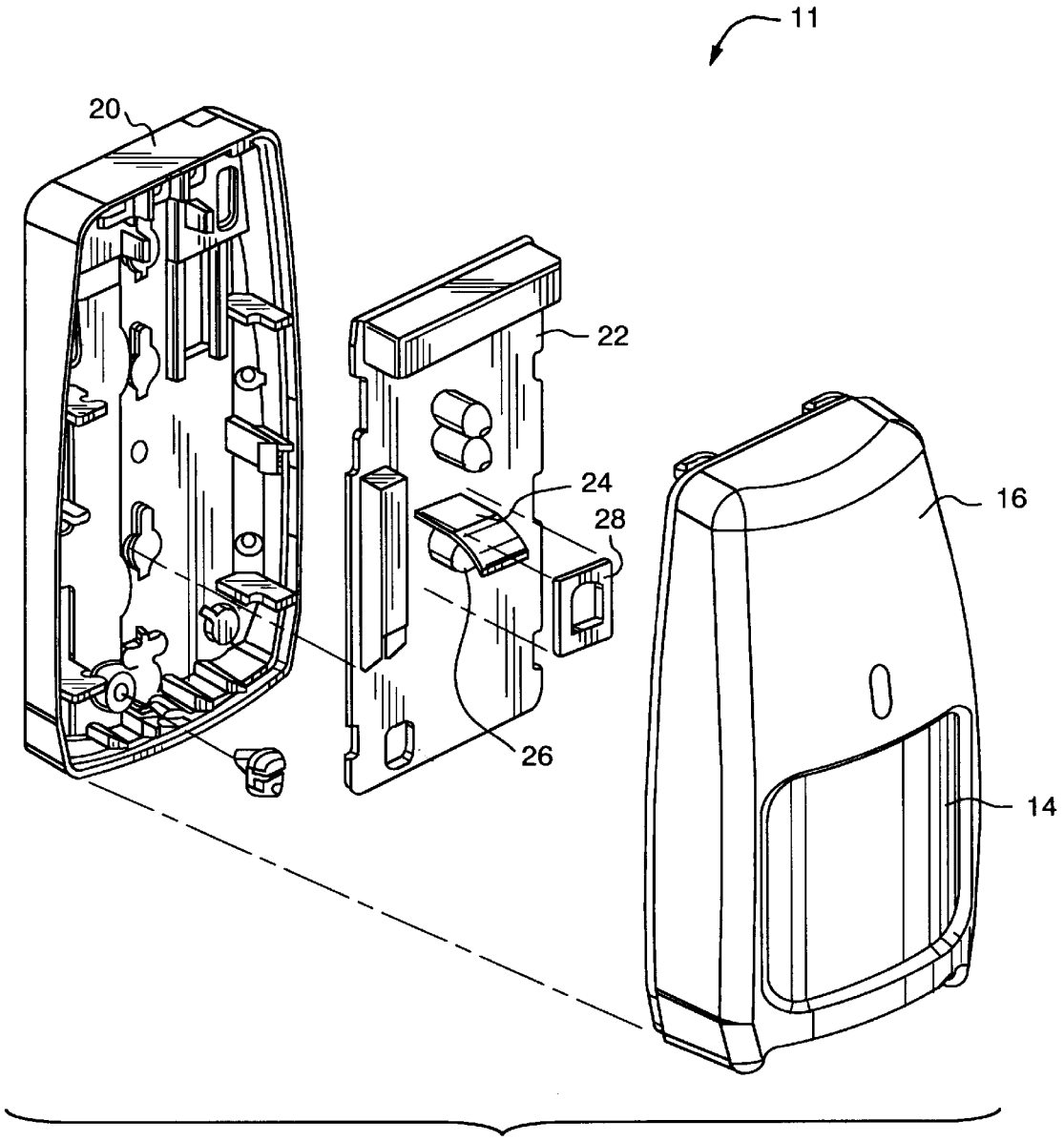
FIG. 2 is an exploded perspective view of a rear assembly of the intrusion sensing system showing a detector and the front of the compound lens.

Referring to FIG. 2, an exploded perspective view of a rear assembly 20 of the intrusion sensing system 11 is shown. A circuit board 22, having an infrared detector 26, a curvilinear-shaped mirror 24 positioned above the infrared detector 26 for reflecting radiation onto the detector 26, insect exclusion enclosure gasket 28 that fits around the perimeter of the detector 26 for interfacing with one end of the insect exclusion enclosure 12, and other circuits, is placed in the front assembly 16 and the rear assembly 20 mates with the front assembly 16 and they snap together. Often there are openings in the rear assembly 20 for mounting purposes which also provides a means of entry for insects.

Figure 3:
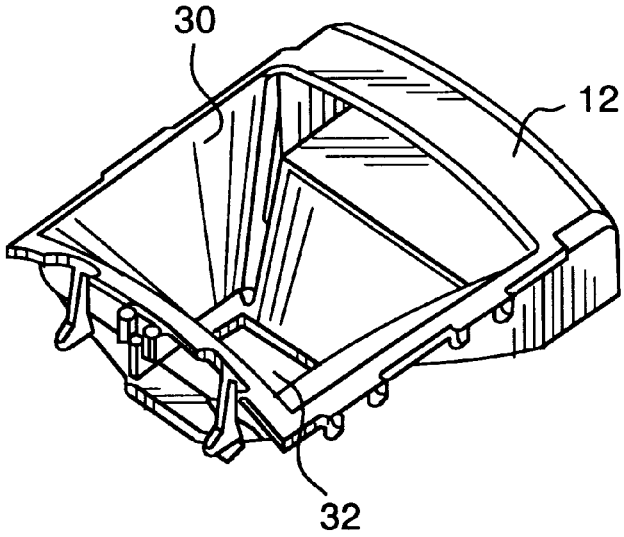
FIG. 3 is a perspective view of the insect exclusion enclosure showing a front view of the enclosure.
Figure 4:
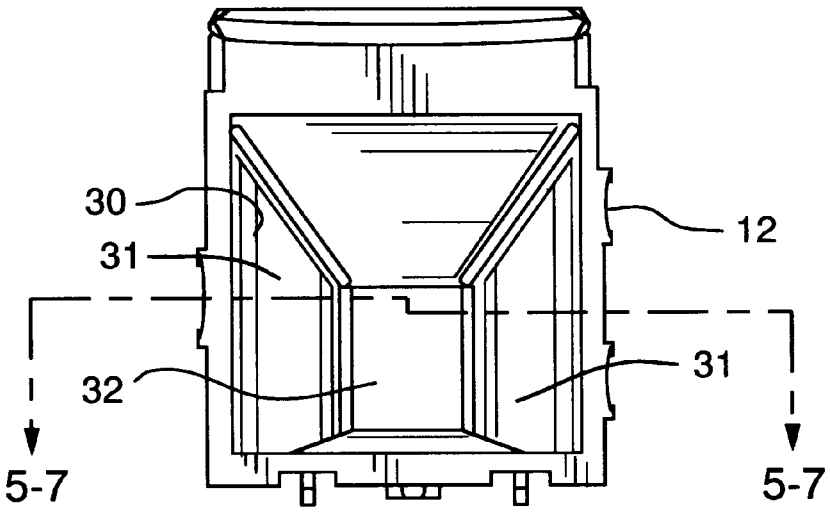
FIG. 4 is a front elevational view of the insect exclusion enclosure.

Referring to FIG. 3 and FIG. 4, FIG. 3 shows a perspective view of the insect exclusion enclosure 12 having a wide front opening 30 that is adjacent to the compound lens 14 and the smaller opening 32 of the back 32 into which the curvilinear-shaped mirror 24 and infrared detector 26 protrude in the assembled system. FIG. 4 is a front elevational view of the insect exclusion enclosure 12 showing side walls 31 and the smaller opening 32 at the back of the enclosure 12.

Figure 5:
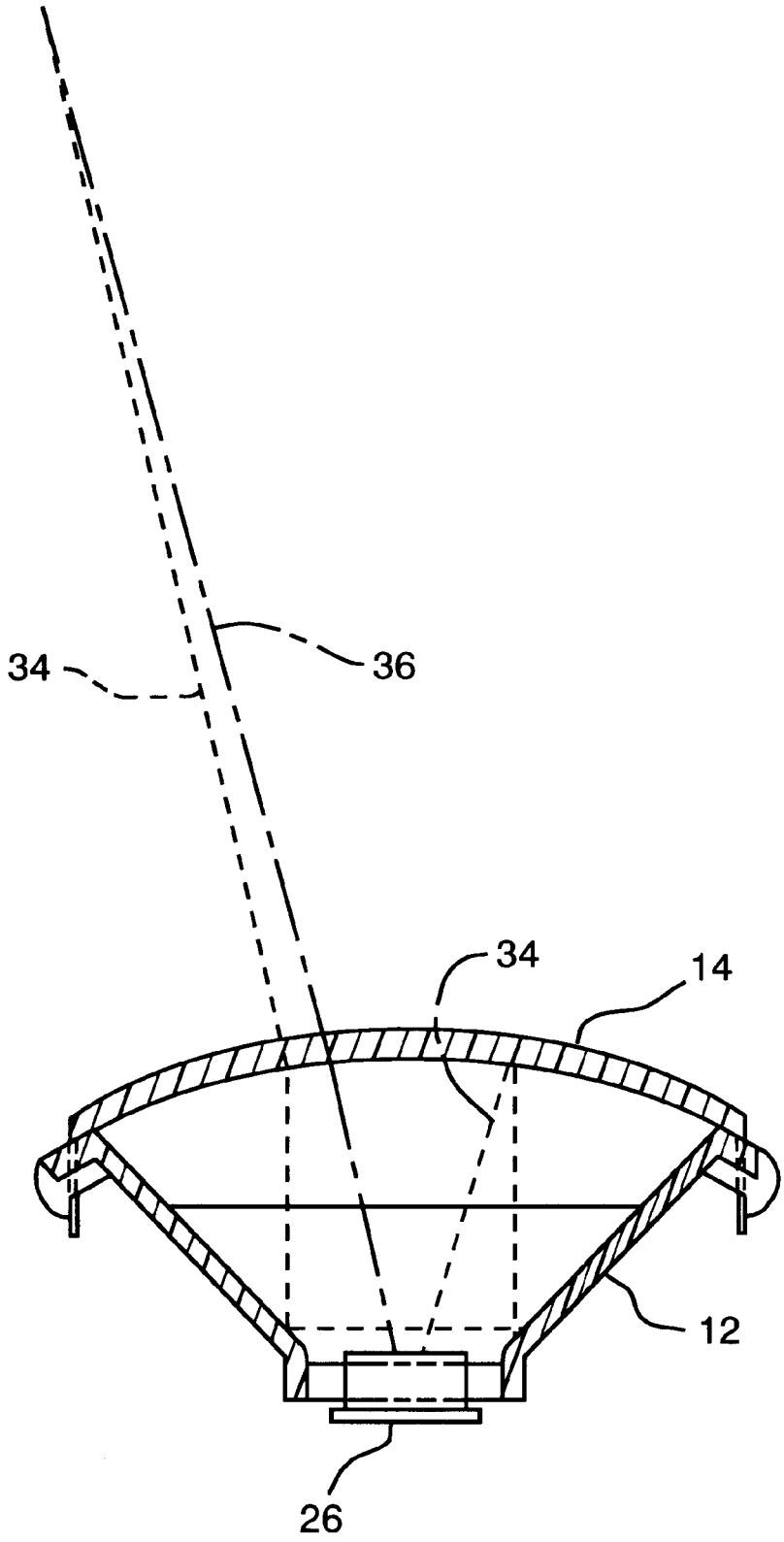
FIG. 5 is a cross-sectional view of the insect exclusion enclosure of FIG. 4 having attached thereto a compound lens and infrared detector showing repeated reflections of a superfluous radiation path and no reflection of a non-superfluous radiation path.

Referring to FIG. 5, a cross-sectional view of the insect exclusion enclosure 12, compound lens 14 and infrared detector 26 is shown and an example superfluous radiation path 34 when the insect exclusion enclosure 12 does not comprise pigmentation, texturing and/or contouring. Also shown is a path 36 for beneficial or non-superfluous radiation which arrives directly at the infrared detector 26. The superfluous radiation path 34 arrives at the infrared detector 26 after repeated reflection inside the insect exclusion enclosure 12.

Figure 6:
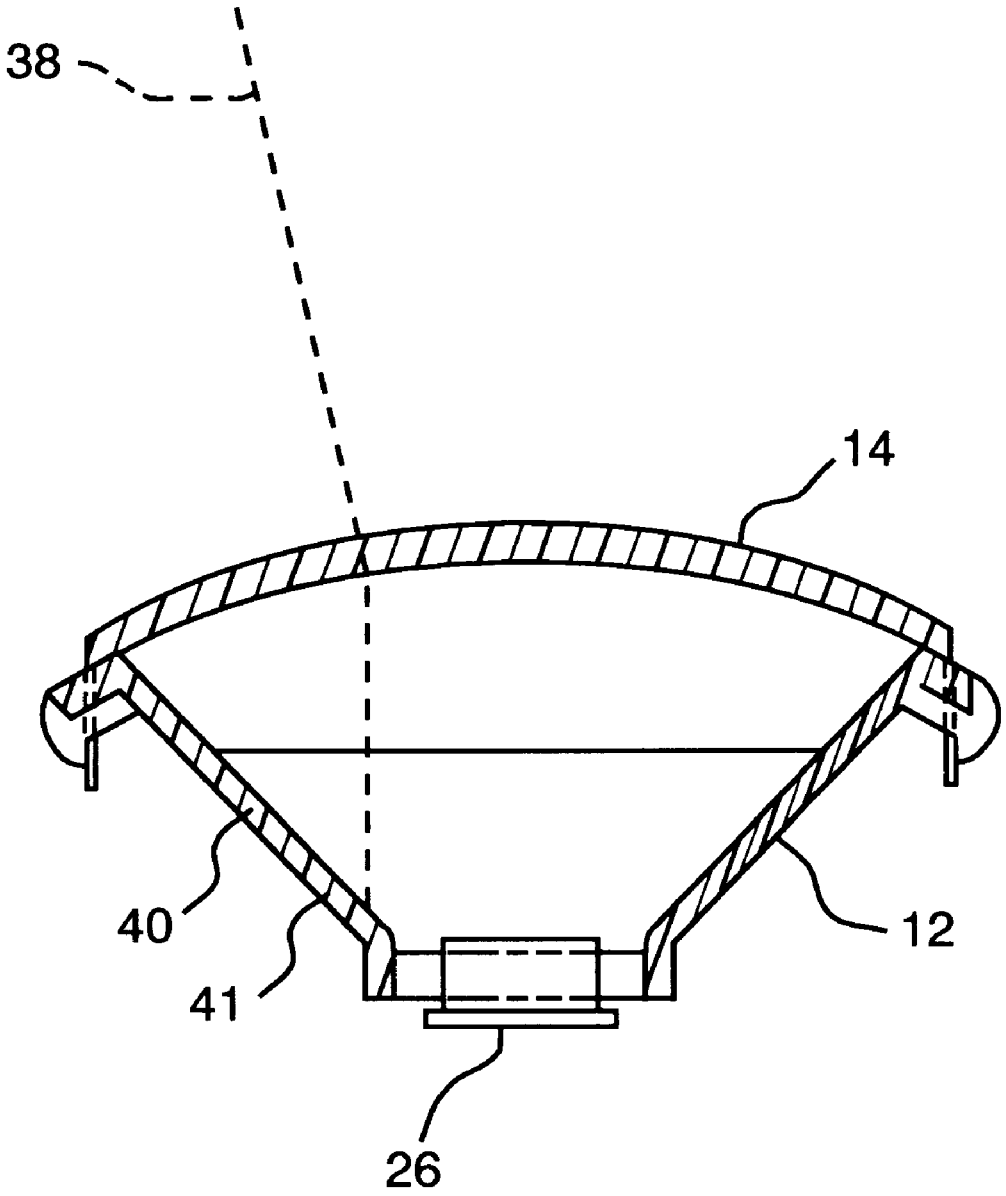
FIG. 6 is a cross-sectional view of the insect exclusion enclosure of FIG. 4 having attached thereto a compound lens and detector illustrating no reflections of an example superfluous radiation path when the insect exclusion enclosure has pigmentation.
Figure 7:
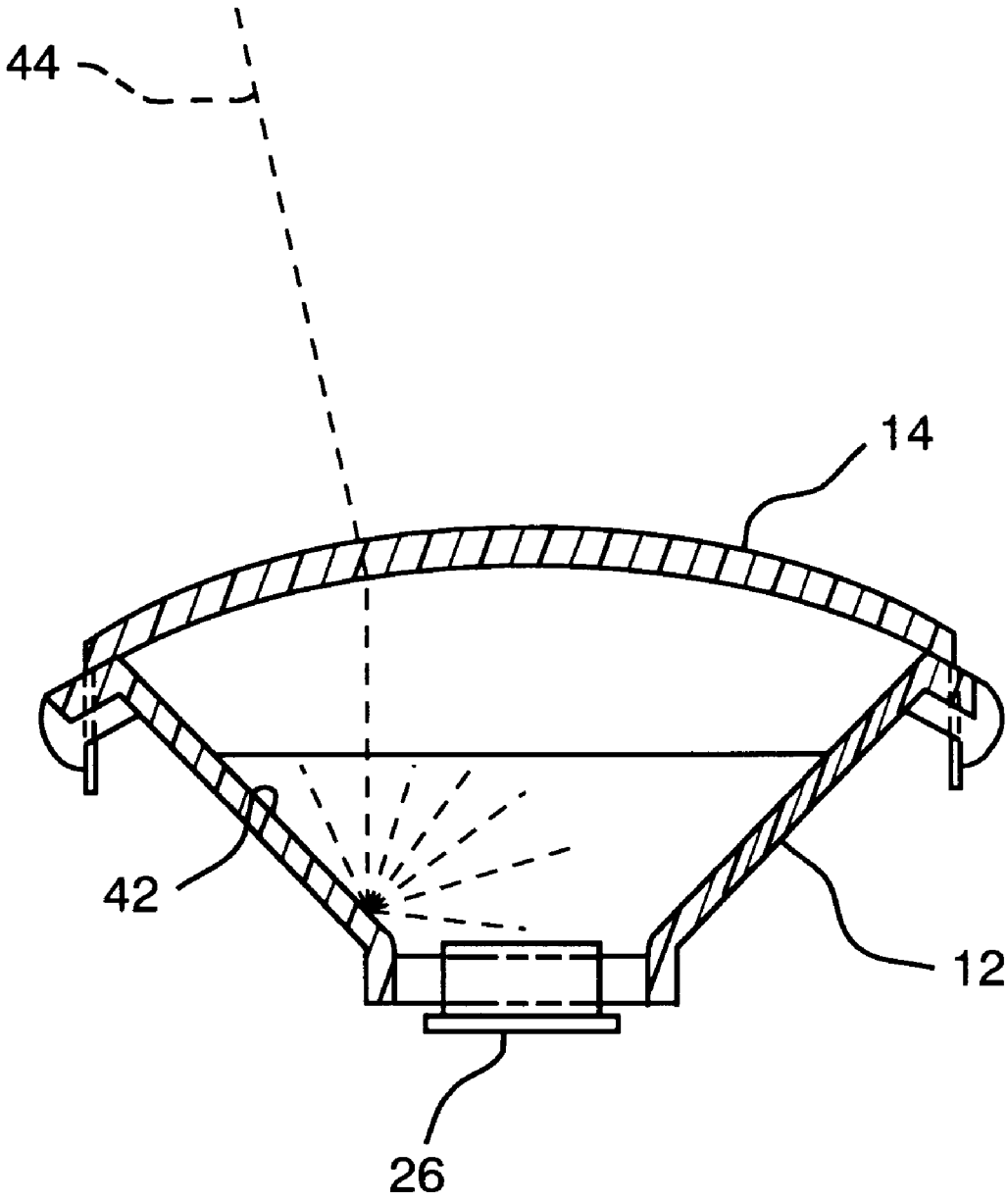
FIG. 7 is a cross-sectional view of the insect exclusion enclosure of FIG. 4 having attached thereto a compound lens and infrared detector illustrating scattering of an example superfluous radiation path when the insect exclusion enclosure comprises texturing.

Referring now to FIG. 6, a cross-sectional view is shown of the insect exclusion enclosure 12 comprising pigmentation 40 added to the material forming the insect exclusion envelope. A superfluous radiation path 38 is illustrated being absorbed by a side 41 of the insect exclusion enclosure 12. The pigmentation 40 most effectively produces a black insect exclusion enclosure 12. The material used to injection mold the insect exclusion enclosure 12 is a polycarbonate plastic which may be embodied by Lexan 141 manufactured by General Electric Co., of Pittsfield, Massachusetts. The pigment used with the Lexan 141 comprises 0.2% carbon black of 24 nm particle size.

Figure 8A:
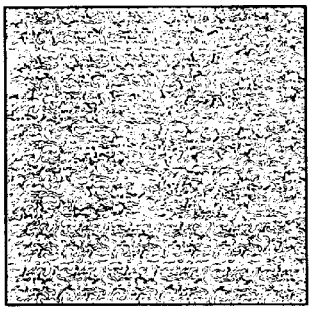
FIG. 8A shows a textured surface for the inner surfaces of the insect exclusion enclosure of FIG. 7 for scattering superfluous radiation.
Figure 8B:
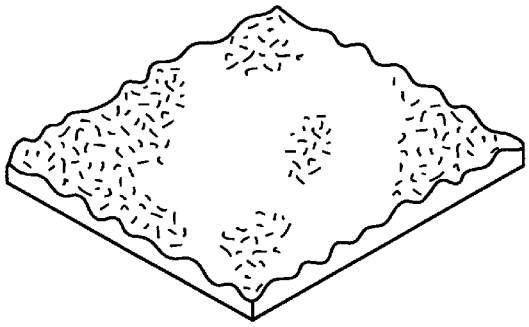
FIG. 8B is a perspective view of a portion of a textured surface of the insect inclusion enclosure of FIG. 7.

Referring to FIG. 7 and FIGS. 8A, 8B and 8C, FIG. 7 illustrates a cross-sectional view of the insect exclusion enclosure 12 comprising a textured surface 42. An example superfluous radiation path 44 strikes the textured surface 42 of the insect exclusion enclosure 12 and is scattered, so that it does not reflect and impinge upon the infrared detector 26. Surface texturing is defined as the repetitive or random deviations from the normal surface which form a three-dimensional topography of the surface. FIG. 8A shows a typical textured surface. FIG. 8B is a perspective view of a portion of the textured surface of the insect exclusion enclosure 12.

Figure 8C:
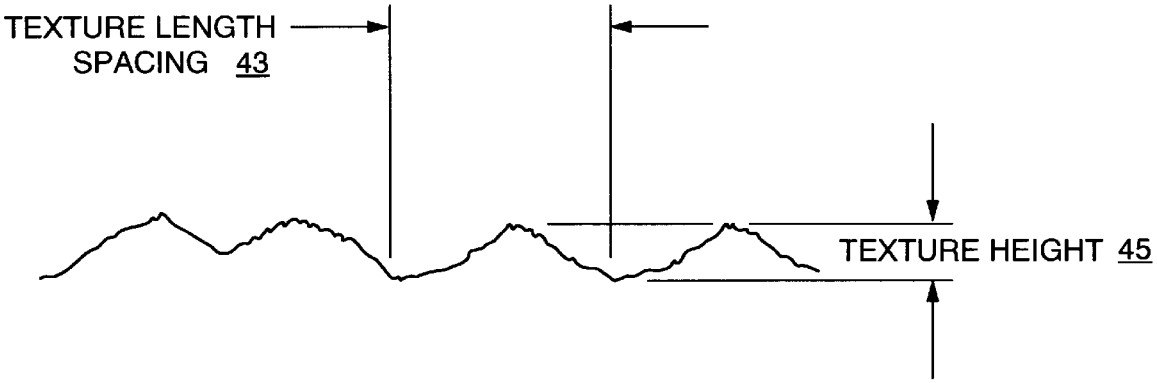
FIG. 8C is an enlarged end elevational view of the textured surface of the insert exclusion enclosure of FIG. 8B showing texture height and texture length spacing.

FIG. 8C shows an enlarged cross-sectional view of the textured surface of FIGS. 8A and BB having a texture length spacing 43 of 0.008 inches and a texture height 45 of 0.003 inches.

Figure 9:
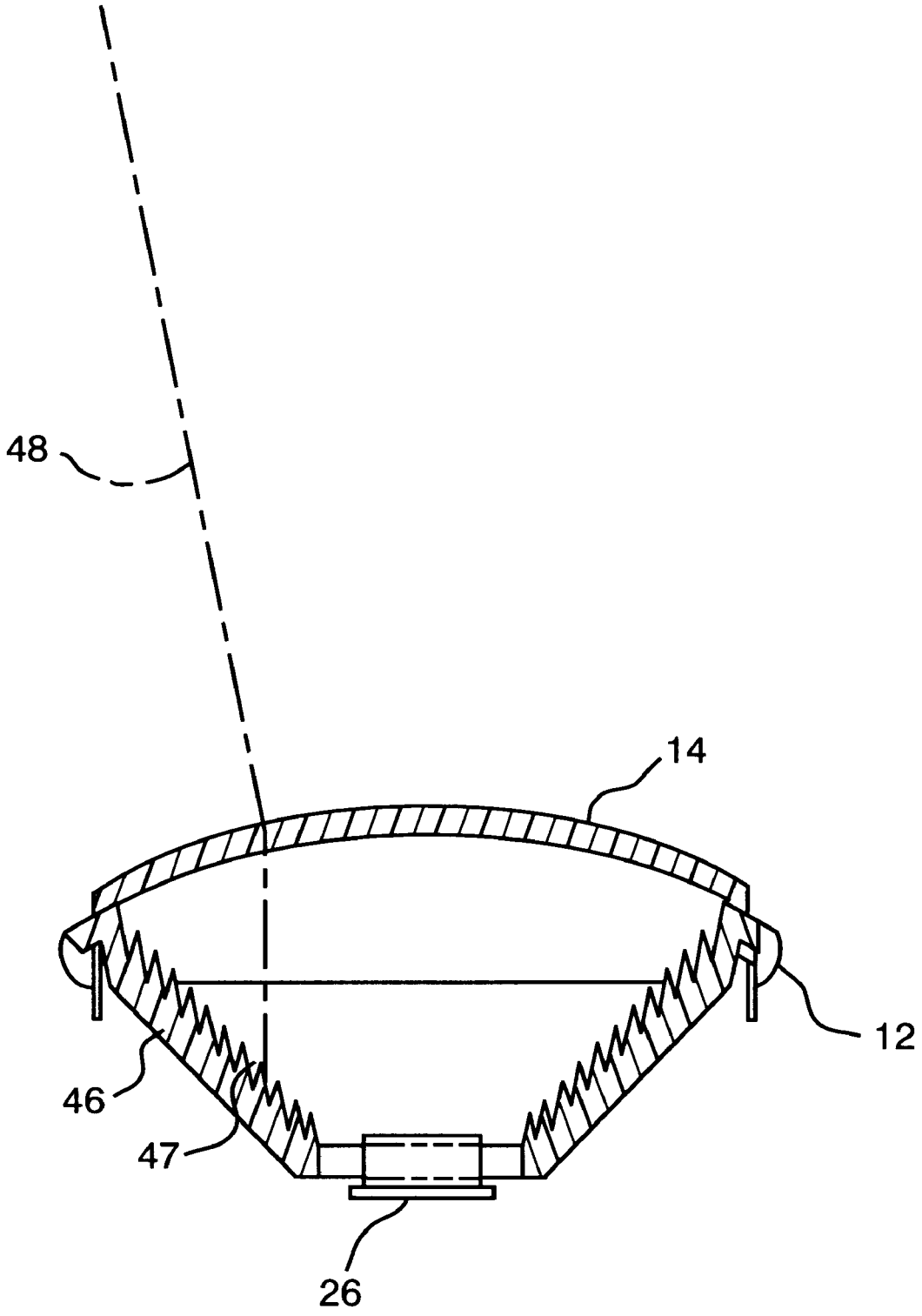
FIG. 9 is a cross-sectional view of the insect exclusion enclosure of FIG. 4 having attached thereto a compound lens and infrared detection illustrating scattering of an example superfluous radiation path when the insect exclusion enclosure comprises contouring.

Referring to FIG. 9, a cross-sectional view is illustrated of the insect exclusion enclosure 12 comprising contouring on the surfaces of its inner walls. A superfluous radiation path 48 is illustrated being attenuated by multiple lossy reflections by the sides 46 of the insect exclusion enclosure 12 by providing the contours 47 on the inner walls of the enclosure 12. Surface contouring 47 supersedes surface texturing as shown in FIGS. 8A and 8C when the texturing height exceeds the length of the traversing run. These dimensions cause repeated reflections within the valleys of the contouring as shown in FIG. 9, constituting repeated lossy reflections.

Figure 10B:
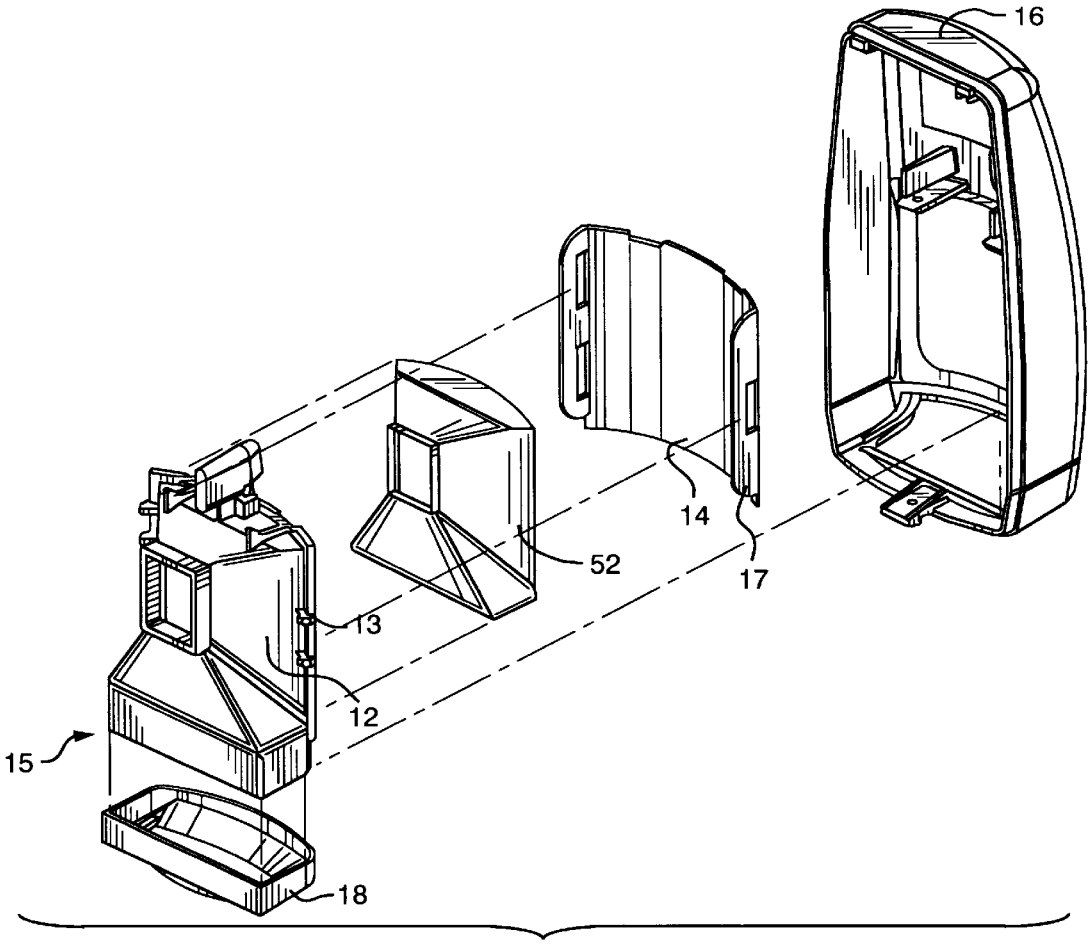
FIG. 10B is an exploded perspective view of the front housing assembly of FIG. 10A showing a pigmented, textured and/or contoured insert placed inside an insect exclusion enclosure.
Figure 10A:
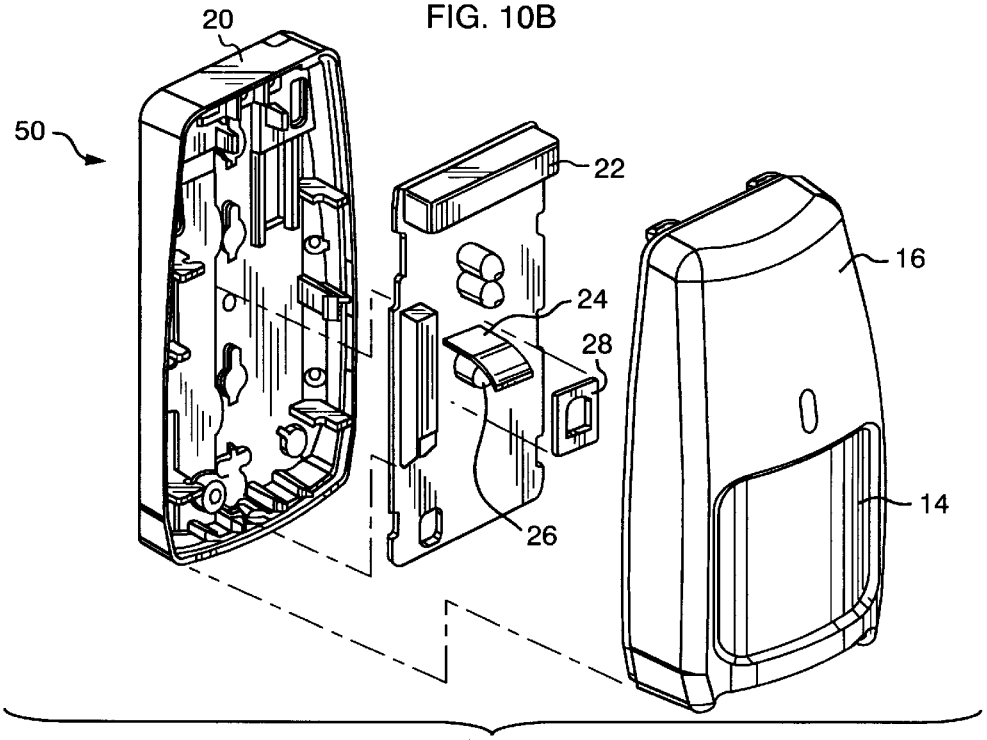
FIG. 10A is an exploded perspective view of an alternate embodiment of an intrusion sensing system having an insert device for absorbing or scattering superfluous radiation.

Referring now to FIG. 10A and FIG. 10B, an exploded perspective view of an alternate embodiment of an intrusion sensing systems 50 is shown. FIG. 10A shows an exploded perspective view of the complete sensing system 50 comprising the rear assembly 20, circuit board 22 having mounted thereon the infrared detector 26 with a curvilinear-shaped mirror 24 mounted adjacent to and above the infrared detector 26, and a front assembly 16. FIG. 10B shows an exploded perspective view of the front assembly 15 comprising a front housing 16, an insect exclusion enclosure 12, a pigmented textured and/or contoured insert 52 having the general shape of the insect exclusion enclosure 12 which is placed inside the insect exclusion enclosure and the compound lens 14 which is attached to the insect exclusion enclosure 12 by engaging the lens tabs 17 over hooks 13 on the insect exclusion enclosure 12. A window 18 is slid onto the bottom of the insect exclusion enclosure 12. The insect exclusion enclosure 12 with the compound lens 14 and window 18 attached thereto and comprising the insert 52 snaps onto the rear of the front housing 16. The front assembly 15 then snaps into the rear assembly 20 and the insect exclusion enclosure 12 contacts the circuit board 22 via the insect exclusion enclosure gasket 28. This embodiment of the intrusion sensing system 50 comprises the benefits of absorbing and/or scattering of superfluous radiation by the insertion of the insert 52 into an existing intrusion sensing system.

Figure 11B:
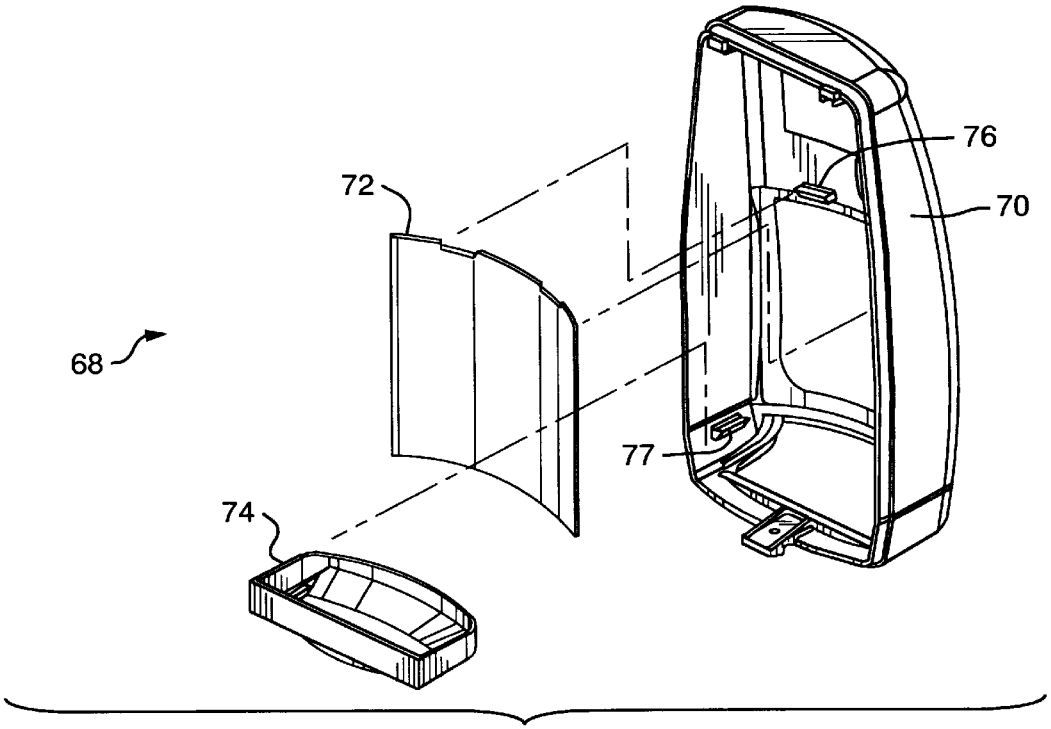
FIG. 11B is an exploded perspective view of the front housing assembly of FIG. 11A showing the compound lens attached to the front housing.
Figure 11A:
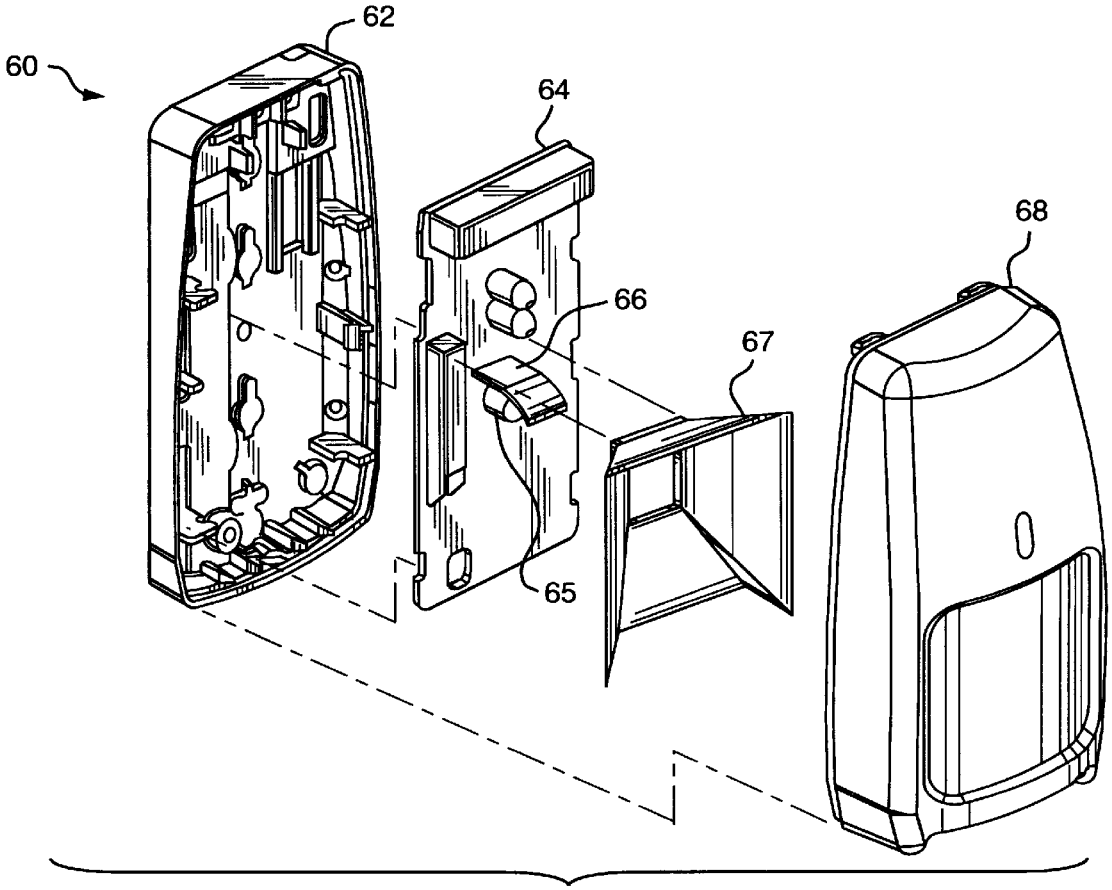
FIG. 11A is an exploded perspective view of another alternate embodiment of an intrusion sensing system having a housing that seals out insects and a baffle attached around the perimeter of an infrared detector on a circuit board for absorbing and or scattering superfluous radiation.

Referring now to FIG. 11A and FIG. 11B, an exploded perspective view of another alternate embodiment of an intrusion system 60 is shown. FIG. 11A shows an exploded perspective view of the system 60 comprising a rear housing 62, a circuit board 64, a superfluous radiation absorber or baffle that has been pigmented, textured and/or contoured as previously described which is attached to the circuit board 64. The circuit board 64 is attached to the rear housing 62 and a front assembly 68 snaps together with the rear housing 62 sealing the system 60 against insect entry.

Referring to FIG. 11B, an exploded perspective of the front assembly 68 is shown. The front assembly 68 comprises a compound lens 72 attached to the front housing 70 by means of appropriate latches 76 on the front housing 70. A window 74 is attached to the bottom of the front housing 70 by appropriate snap latches 77. This embodiment provides an intrusion sensing system 60 in which the superfluous radiation absorber does not contact the front housing 70. When the sensing system 60 is assembled the rear housing 62 is mated with the front housing 68 and there are no openings for bug access to the inside. Also, there are no mounting holes that otherwise allow bug entry. The baffle 67, which is pigmented, textured and/or contoured to absorb or scatter superfluous radiation, is attached to the circuit board 64 around the perimeter of the infrared detector 65. When the sensor system 60 is used in an application, it may be mounted, for example, with tape means on the rear of housing 62.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by letters patent of the united states is:

1. An intrusion sensing system comprising:

(a) a front assembly having a compound lens for focusing radiation;

(b) a circuit board including a radiation detector for sensing said radiation and circuitry for processing detected radiation, wherein said radiation detector and associated circuitry are responsive to a useful wavelength band of radiation; and (c) a rear assembly for mating with said front assembly and enclosing said circuit board within said front assembly and said rear assembly;

(d) said front assembly comprising means attached to said compound lens for excluding insects from said radiation detector and preventing superfluous radiation from reaching said radiation detector, said superfluous radiation comprising radiation inside and outside said useful band which is not focused on said radiation detector but enters said lens from outside said system.

2. The intrusion sensing system as recited in claim 1 wherein said insect excluding means comprises an opening on a first end adjacent to said compound lens for receiving said focused radiation and an opening on a second end which is smaller than said opening on said first end for accepting said radiation detector extending therethrough from said adjacent circuit board.

3. The intrusion sensing system as recited in claim 1 wherein said insect excluding means comprises a pigmentation for absorbing said superfluous radiation.

4. The intrusion sensing system as recited in claim 1 wherein said insect excluding means comprises a textured surface for scattering superfluous radiation.

5. The intrusion sensing system as recited in claim 1 wherein said insect excluding means comprises a contoured surface for preventing said superfluous radiation from reflecting onto said radiation detector.

6. The intrusion sensing system as recited in claim 1 wherein said front assembly comprises another window on a bottom end of said front assembly and said insect excluding means for receiving radiation; and said radiation entering said sensing system through said bottom end window strikes mirrors above said detector for reflecting said radiation onto said radiation detector.

7. The intrusion sensing system as recited in claim 3 wherein said pigmentation provides a black color to said insect excluding means.

8. The intrusion sensing system as recited in claim 4 wherein said textured surface comprises repetitive, random deviations from a normal smooth surface to form a three-dimensional topography on said surface.

9. The intrusion sensing system as recited in claim 5 wherein said contoured surface comprises peaks and valleys for causing lossy reflections of said superfluous radiation within said valleys.

10. The intrusion sensing system as recited in claim 2 wherein a sealing means is disposed around said second end opening of said insect excluding means when said second end opening is disposed against said circuit board.

11. An intrusion sensing system comprising:

(a) a front assembly having a compound lens for focusing radiation;

(b) a circuit board including a radiation detector positioned opposite said compound lens for sensing said radiation and circuitry for processing detected radiation, wherein said radiation detector and associated circuitry are responsive to a useful wavelength band of radiation; and (c) a rear assembly for mating with said front assembly and enclosing said circuit board within said front assembly and said rear assembly;

(d) said front assembly comprising means attached to said compound lens for excluding insects from said radiation detector;

(e) said front assembly further comprising means inserted within said insect excluding means for suppressing superfluous radiation from reaching said radiation detector, said superfluous radiation comprising radiation inside and outside said useful band which is not focused on said radiation detector but enters said lens from outside said system.

12. The intrusion sensing system as recited in claim 11 wherein said insect excluding means and said suppressing means comprises an opening on a first end adjacent to said compound lens for receiving said focused radiation and an opening on a second end which is smaller than said opening on said first end for accepting said radiation detector extending therethrough from said adjacent circuit board.

13. The intrusion sensing system as recited in claim 11 wherein said suppressing means comprises a pigmentation for absorbing said superfluous radiation.

14. The intrusion sensing system as recited in claim 11 wherein said insert suppressing means comprises a textured surface for scattering superfluous radiation.

15. The intrusion sensing system as recited in claim 11 wherein said insert suppressing means comprises a contoured surface for preventing said superfluous radiation from reflecting onto said radiation detector.

16. The intrusion sensing system as recited in claim 11 wherein said front assembly comprises another window on a bottom end of said front assembly and said insect excluding means for receiving radiation; and said radiation entering said sensing system through said bottom end window strikes mirrors above said detector for reflecting said radiation onto said radiation detector.

17. The intrusion sensing system as recited in claim 13 wherein said pigmentation provides a black color to said suppressing means.

18. The intrusion sensing system as recited in claim 14 wherein said textured surface comprises repetitive, random deviations from a normal smooth surface to form a three-dimensional topography on said surface.

19. The intrusion sensing system as recited in claim 15 wherein said contoured surface comprises peaks and valleys for causing lossy reflections of said superfluous radiation within said valleys.

20. An intrusion sensing system comprising:

(a) a front assembly having a compound lens for focusing radiation;

(b) a circuit board including a radiation detector for sensing said radiation and circuitry for processing detected radiation, wherein said radiation detector and associated circuitry are responsive to a useful wavelength band of radiation;

(c) a baffle, having a first open end attached around the perimeter of said radiation detector and a second open end facing said compound lens, for suppressing superfluous radiation from reaching said radiation detector, said superfluous radiation comprising radiation inside and outside said useful band which is not focused on said radiation detector but enters said lens from outside said system; and, (d) a rear assembly for sealably mating with said front assembly and enclosing said circuit board within said front assembly and said rear assembly thereby excluding insects from entering said sensing system.

21. The intrusion sensing system as recited in claim 20 wherein said baffle comprises said opening on a second end in front of said compound lens for receiving said focused radiation and said opening on a first end which is smaller than said opening on said second end for accepting said radiation detector extending therethrough from said adjacent circuit board.

22. The intrusion sensing system as recited in claim 20 wherein said baffle comprises a pigmentation for absorbing said superfluous radiation.

23. The intrusion sensing system as recited in claim 20 wherein said baffle comprises a textured surface for scattering superfluous radiation.

24. The intrusion sensing system as recited in claim 20 wherein said baffle comprises a contoured surface for preventing said superfluous radiation from reflecting onto said radiation detector.

25. The intrusion sensing system as recited in claim 20 Wherein said-front assembly comprises another window on a bottom end of said front assembly for receiving radiation; and said radiation entering said sensing system through said bottom end window strikes mirrors above said detector for reflecting said radiation onto said radiation detector.

26. The intrusion sensing system as recited in claim 22 wherein said pigmentation provides a black color to said baffle.

27. The intrusion sensing system as recited in claim 23 wherein said textured surface comprises repetitive, random deviations from a normal smooth surface to form a three-dimensional topography on said surface.

28. The intrusion sensing system as recited in claim 24 wherein said contoured surface comprises peaks and valleys for causing lossy reflections of said superfluous radiation within said valleys.

29. A method of suppressing superfluous radiation in an intrusion sensing system comprising the steps of:

(a) providing a front assembly having a compound lens for focusing radiation;

(b) sensing said radiation with a detector positioned on a circuit board including circuitry coupled to said detector for processing sensed radiation, wherein said radiation detector and associated circuitry are responsive to a useful wavelength band of radiation;

(c) enclosing said intrusion sensing system with a rear assembly which is disposed adjacent to one side of said circuit board and joined together with the periphery of said front assembly; and (d) providing a suppressing means within said front assembly for preventing superfluous radiation from reaching said detector, said superfluous radiation comprising radiation inside and outside said useful band which is not focused on said detector but enters said lens from outside said system, said suppressing means attached to said compound lens prevents insects from entering the space envelope of said suppressing means and affecting said detector.

30. The method as recited in claim 29 wherein said method comprises the step of adding a pigmentation to the material of said suppressing means for absorbing said superfluous radiation.

31. The method as recited in claim 29 wherein said method comprises the step of providing a textured surface on said suppressing means for scattering superfluous radiation.

32. The method as recited in claim 29 wherein said method comprises the step of providing a contoured surface on said suppressing means for preventing superfluous radiation from reflecting onto said radiation detector.

33. The method as recited in claim 32 wherein said step of providing a contoured surface comprises the step of providing peaks and valleys for causing lossy reflections of said superfluous radiation within said valleys.

34. A method of suppressing radiation in an intrusion sensing system comprising the steps of:

(a) providing a front assembly having a compound lens for focusing radiation;

(b) sensing said radiation with a detector positioned on a circuit board including circuitry coupled to said detector for processing sensed radiation, wherein said radiation detector and associated circuitry are responsive to a useful wavelength band of radiation;

(c) enclosing said intrusion sensing system with a rear assembly which is disposed adjacent to one side of said circuit board and joined together at the periphery of said front assembly;

(d) excluding insects from said radiation detector with enclosure means attached to said compound lens and positioned within said front assembly; and (e) inserting within said enclosure means for suppressing superfluous radiation from reaching said detector, said superfluous radiation comprising radiation inside and outside said useful band which is not focused on said detector but enters said lens from outside said system.

35. The method as recited in claim 34 wherein said method comprises the step of adding a pigmentation to the material of said suppressing means for absorbing said superfluous radiation.

36. The method as recited in claim 34 wherein said method comprises the step of providing a textured surface on said suppressing means for scattering superfluous radiation.

37. The method as recited in claim 34 wherein said method comprises the step of providing a contoured surface on said suppressing means for preventing superfluous radiation from reflecting onto said radiation detector.

* * * * *